United States Patent [19]

Koch

[11] Patent Number: 4,841,222

[45] Date of Patent: Jun. 20, 1989

[54] SWITCHED CURRENT SOURCE

[75] Inventor: Rudolf Koch, Unterhaching, Fed. Rep. of Germany

[73] Assignee: Siemens Aktiengesellschaft, Berlin and Munich, Fed. Rep. of Germany

[21] Appl. No.: 9,251

[22] Filed: Jan. 30, 1987

[30] Foreign Application Priority Data

Feb. 3, 1986 [DE] Fed. Rep. of Germany ..... 3603241

[51] Int. Cl.[4] ..... G05F 3/26

[52] U.S. Cl. ..... 323/311; 323/312; 323/315; 307/296.8

[58] Field of Search ..... 323/311-316; 363/60; 307/296 R, 297; 330/267, 288

[56] References Cited

U.S. PATENT DOCUMENTS 4,405,868 9/1983 Lockwood ..... 363/60 X
4,525,682 6/1985 Lai et al. ..... 323/315 X
4,536,662 8/1985 Fujii ..... 323/315 X
4,684,831 8/1987 Kruest ..... 323/316 X
4,684,880 8/1987 Chan ..... 323/316

*Primary Examiner*—Patrick R. Salce
*Assistant Examiner*—Todd Emanuel Voeltz
*Attorney, Agent, or Firm*—Herbert L. Lerner; Laurence A. Greenberg

[57] ABSTRACT

A switched current source includes at least two branches, at least one MOS current source transistor connected in common to each of the at least two branches, and at least two MOS switching transistors each being connected in a respective one of the branches and simultaneously forming an additional current source transistor, the at least one current source transistor being connected as a respective cascode with each of the at least two switching transistors.

6 Claims, 2 Drawing Sheets

SWITCHED CURRENT SOURCE

The invention relates to a switched current source, including a static current source containing at least two MOS-transistors connected as cascodes and at least one MOS-transistor operated as a switch.

Switched current sources of this kind are known, for example, from the publication "1985 IEEE International Solid-State Circuits Conference", Feb. 13, 1985, page 32.

An advantage of such a circuit is that the use of two current source transistors connected as a cascode provides a substantially higher internal or inner resistance than when only one current source transistor is used. However, the circuit also has the disadvantage of recharging a parasitic capacitance during each switching process in dependence upon the drain voltages of the switching transistors. Consequently a current which differs from the theoretical current flows during the starting phase of each switch-over process.

It is accordingly an object of the invention to provide a switched current source, which overcomes the hereinafore-mentioned disadvantages of the heretofore-known devices of this general type and in which the aforementioned deviations from the theoretical current are avoided.

With the foregoing and other objects in view there is provided, in accordance with the invention, a switched current source, comprising at least two branches, at least one MOS current source transistor connected in common to each of the at least two branches, and at least two MOS switching transistors each being connected in a respective one of the branches and simultaneously forming an additional current source transistor, the at least one current source transistor being connected as a respective cascode with each of the at least two switching transistors.

In accordance with another feature of the invention, there are provided at least two additional branches each being complementary and connected to a respective one of the at least two first-mentioned branches forming a bi-directional switched current source.

In accordance with a further feature of the invention, there is provided a capacitive load coupled to at least one of the branches.

In accordance with an added feature of the invention, there are provided at least two series-connected MOS-transistors connected as diodes for supplying switching voltage to the at least two switching transistors and for supplying voltage to the at least one current source transistor, the at least two transistors connected as diodes forming current mirrors together with one of the at least two switching transistors and the at least one current source transistor, one of the transistors connected as a diode providing gate voltage for the at least one current source transistor, and the transistors connected as diodes selectively providing gate voltages for one of the at least two switching transistors.

In accordance with a concomitant feature of the invention, there are provided support capacitors each being connected to a respective one of the transistors connected as a diode.

Other features which are considered as characteristic for the invention are set forth in the appended claims.

Although the invention is illustrated and described herein as embodied in a switched current source, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
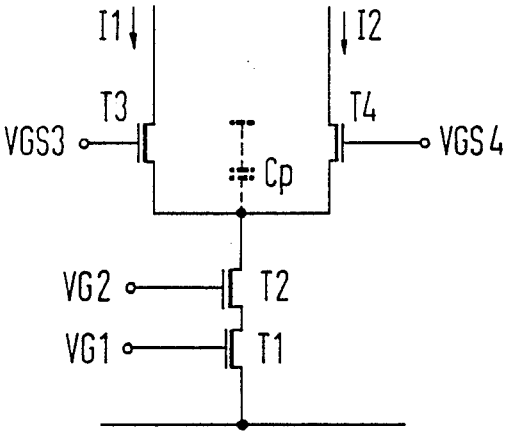
FIG 1 PRIOR ART
FIG. 1 is a schematic circuit diagram of a prior art switched current source.

Referring now to the figures of the drawings in detail and first, particularly, to FIG. 1 thereof, there is seen a prior art current source having two MOS-transistors T1, T2, connected as a cascode and a respective MOS-switching transistor T3, T4 in each branch. The two current source transistors T1, T2 are operated at saturation by fixed gate voltages VG1, VG2 respectively. The switching transistors T3, T4 are operated as switches by respective gate voltages VGS3, VGS4 and in the conducting state they operate as a triode. Depending upon whether the switching transistor T3 or the switching transistor T4 is conducting, a current I1 or I2, both of equal value, flows through the corresponding switching transistor and the current source transistors T1, T2. A circuit of the type described above has the advantage of obtaining a substantially higher internal resistance through the use of the two current source transistors T1, T2 connected as a cascode, than when only one current source transistor is used. However, the circuit also has the disadvantage of recharging a parasitic capacitance Cp during each switching process, in dependence upon the drain voltages of the switching transistors T3, T4. The parasitic capacitance Cp is shown by broken lines and is located at a connection point between the current source transistors T1, T2 and the switching transistors T3, T4. Consequently a current which differs from the theoretical currents I1, I2 flows in the starting phase of each switch-over process.

As mentioned above, it is an object of the invention to provide a switched current source of the type in question wherein the aforementioned deviations from the theoretical current are avoided.

Figure 2:
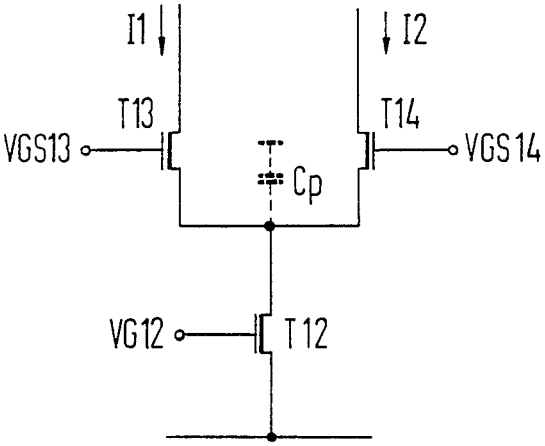
FIG. 2 is a fundamental circuit diagram of an embodiment of a switched current source in accordance with the invention.

The embodiment of a switched current source according to the invention shown in FIG. 2, includes a MOS-transistor T12 which forms a current source transistor and a respective additional MOS-transistor T13, T14 in each branch. In this case the current source transistor T12 is equivalent to the current source transistor T1 of the prior-art circuit shown in FIG. 1.

In contrast to the prior-art switched current source shown in FIG. 1, the transistors T13, T14, which correspond to a degree of the transistors T3, T4 of the switched current source of FIG. 1, not only form switching transistors but also form current source transistors, i.e. the transistors T12, T13 and T12, T14 in each case form a pair of current source transistors which are connected as a cascode, along the lines of the transistors T1, T2 of the previously prior art switched current source in FIG. 1. Thus it is an essential feature of the invention that the two transistors T13, T14 simultaneously fulfill the function of current source transistors and switching transistors. This function is obtained due to the fact that the transistors T13, T14 are operated in saturation, for which purpose the gate voltages of the two transistors T13, T14 are switched over between the two suitable constant voltages in such manner that one of the two transistors conducts in each case. The respective gate voltages of the transistors in the switched current source shown in FIG. 2 have been given reference symbols VG12, VGS13 and VGS14.

The two transistors T13 and T14, which operate simultaneously as current source transistors and as switching transistors are operated at saturation, independently of the drain voltages at a common node connected to these two transistors, which represents their source node. Therefore, the voltage is kept constant and the disadvantageous recharging of the parasitic capacitance Cp is avoided.

At least one of the branches of the switched current source shown in FIG. 2 can be coupled to a non-illustrated capacitive load through which the current I1, which may correspond approximately to reference potential, flows.

Figure 3:
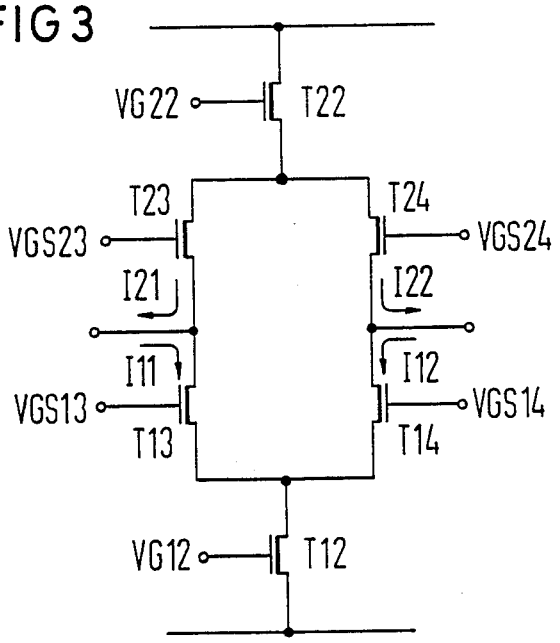
FIG. 3 is a fundamental circuit diagram of another embodiment of a switched current source in accordance with the invention.

FIG. 3 represents an embodiment of a switched current source in accordance with the invention which basically corresponds to the embodiment shown in FIG. 2, although in this case two complementary circuit components corresponding to FIG. 2 have been provided in order to construct a bi-directional current source. In FIG. 3 the corresponding transistors have been given reference symbols T12 to T14 and T22 to T24, whereas the corresponding gate voltages have been given reference symbols VG12, VGS13, VGS14 and VG22; VGS23, VGS24. The currents occurring at the schematically illustrated outputs are given reference symbols I11, I12 and I21, I22 and due to the complementary construction of the switched current sources, oppositely directed currents which are identified by arrows, are produced.

Figure 4:
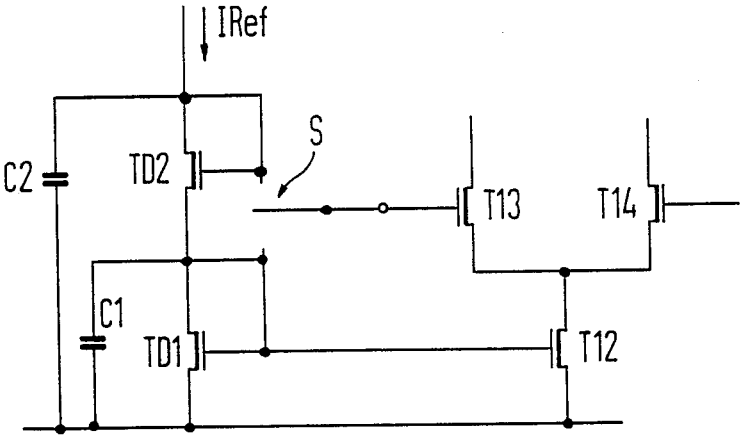
FIG. 4 is a fundamental circuit diagram of an embodiment of a circuit which generates gate voltages of switching transistors and current source transistors of switched current sources in accordance with the invention.

FIG. 4 shows an embodiment of a circuit which serves to generate the gate voltages for a switched current source corresponding to the embodiments of FIGS. 2 and 3. The circuit of FIG. 4 includes two series-connected MOS-transistors TD1, TD2 which are connected as diodes and to which a reference current IRef is fed. The transistors T13, T14 which simultaneously operate as current source transistors and switching transistors, must be supplied with two suitable constant gate voltages for operation in the saturation range. Therefore, a switch S is provided through which the gate of a transistor can be switched over between the two transistors TD1, TD2 which are connected as diodes, so that in one case the sum voltage of the two diodes is connected to the gate of the transistor and in another case only the voltage of the lower diode TD1 is connected to the gate of the transistor. Of course this circuit operates in such a manner that in each case the voltage of both diodes is connected to one transistor, such as the transistor T13, and at the same time only the voltage of the lower diode TD1 is connected to the gate of the other transistor, such as the transistor T14.

At the same time the voltage of the lower diode TD1 can represent the gate voltage for the current source transistor T12 which is likewise operated at saturation.

It is preferable to provide support capacitors C1, C2 to support the voltages of the diode path TD1, TD2.

It should be noted that the combination of the two transistors TD1, TD2, which are connected as diodes and the transistors T12, T13 represents a current reflector or current mirror and that a corresponding configuration for the other branch having the transistor T14 has not been shown so as not to impair the clarity of the drawing. Naturally, the series connection of the transistors TD1, TD2 which are connected as diodes can also be used to produce the gate voltage for the transistor T14.

The foregoing is a description corresponding in substance to German Application No. P 36 03 241.7, dated Feb. 3, 1986, the International priority of which is being claimed for the instant application, and which is hereby made part of this application. Any material discrepancies between the foregoing specification and the aforementioned corresponding German application are to be resolved in favor of the latter.

I claim:

1. Switched current source, comprising at least two branches, at least one MOS current source transistor connected in common to each of said at least two branches, and at least two MOS switching transistors each being connected in a respective one of said branches and simultaneously forming an additional current source transistor, said at least one current source transistor being connected as a respective cascode with each of said at least two switching transistors.

2. Current source according to claim 1, including at least two additional branches each being complementary and connected to a respective one of said at least two first-mentioned branches forming a bi-directional switched current source.

3. Current source according to claim 1, including a capacitive load coupled to at least one of said branches.

4. Current source according to claim 2, including a capacitive load coupled to at least one of said branches.

5. Current source according to claim 1, including at least two series-connected MOS-transistors connected as diodes for supplying switching voltage to said at least two switching transistors and for supplying voltage to said at least one current source transistor, said at least two transistors connected as diodes forming current reflectors together with one of said at least two switching transistors and said at least one current source transistor, one of said transistors connected as a diode providing gate voltage for said at least one current source transistor, and said transistors connected as diodes selectively providing gate voltages for one of said at least two switching transistors.

6. Current source according to claim 4, including support capacitors each being connected to a respective one of said transistors connected as a diode.

* * * * *